US005213418A

United States Patent [19]

Dancy et al.

[11] Patent Number: 5,213,418

[45] Date of Patent: May 25, 1993

[54] REUSABLE BAG

[76] Inventors: Kristen Dancy, 90 Hall Rd., Apt. 51, Sturbridge, Mass. 01566; Kal Kassel, 79 Sunset Ave., Lynbrook, N.Y. 11563

[21] Appl. No.: 714,958

[22] Filed: Jun. 13, 1991

[51] Int. Cl.[5] ..... B65D 30/04; B65D 30/08; B65D 30/16; B65D 33/06

[52] U.S. Cl. ..... 383/6; 383/104; 383/107; 383/116; 383/120; 383/121.1; 383/907

[58] Field of Search ..... 383/120, 121.1, 907, 383/104, 107, 6, 116; 229/115

[56] References Cited

U.S. PATENT DOCUMENTS

| | | | |
|---|---|---|---|
| 426,770 | 4/1890 | Claussen | 383/907 |
| 426,842 | 4/1890 | Mortson | 383/907 |
| 1,240,564 | 9/1917 | Harrington | 383/907 |
| 1,767,274 | 6/1930 | Broderick | 383/120 |
| 1,853,013 | 4/1932 | Brady | 383/117 |
| 1,898,838 | 2/1933 | Katz | 383/6 |
| 2,279,327 | 4/1942 | Kehr | 383/120 |
| 2,307,659 | 1/1943 | Avery | 383/6 |
| 2,325,853 | 8/1943 | Harlem | 383/6 |
| 2,584,633 | 2/1952 | Southwick, Jr. | 383/107 |
| 2,960,136 | 11/1960 | Ziff | 383/6 |
| 3,249,286 | 5/1966 | Palmer | 383/907 |
| 3,445,055 | 5/1969 | Port et al. | 383/116 |
| 3,660,150 | 5/1972 | Cooper | 383/117 |
| 3,705,835 | 12/1972 | Badrian | 383/116 |
| 4,500,129 | 2/1985 | Hahn | 383/6 |
| 4,542,826 | 9/1985 | Adams | 383/6 |

FOREIGN PATENT DOCUMENTS

| | | | |
|---|---|---|---|
| 121266 | 10/1984 | European Pat. Off. | 383/108 |
| 1481219 | 4/1967 | France | 229/115 |
| 270419 | 11/1950 | Switzerland | 383/6 |

*Primary Examiner*—Stephen P. Garbe
*Attorney, Agent, or Firm*—Blum Kaplan

[57] ABSTRACT

A reusable bag includes a base. A plurality of side panels are affixed to the base and extend from the base in substantially the same direction. The base and sides of the reusable bag are formed of a semi-rigid form maintaining material which maintains its form while allowing each side and base to collapse upon itself.

11 Claims, 2 Drawing Sheets

FIG. 3
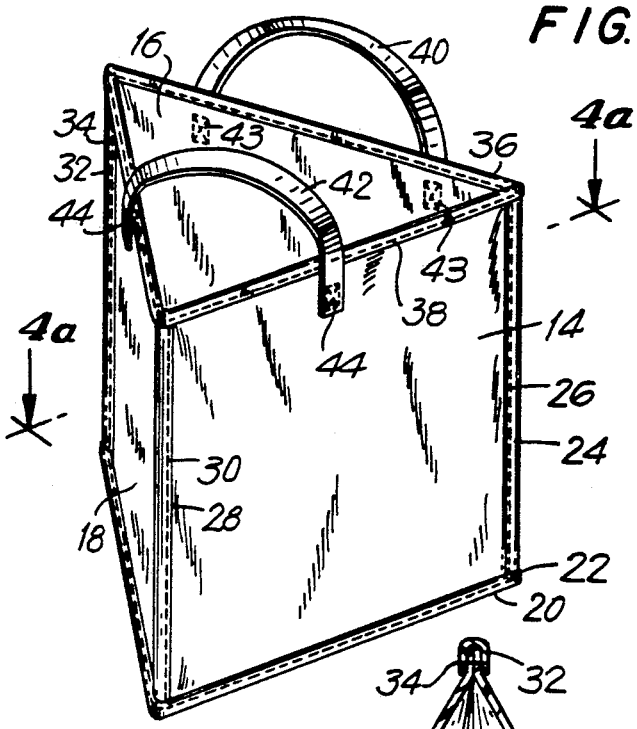
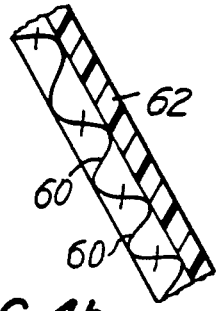
FIG. 4b
FIG. 4a
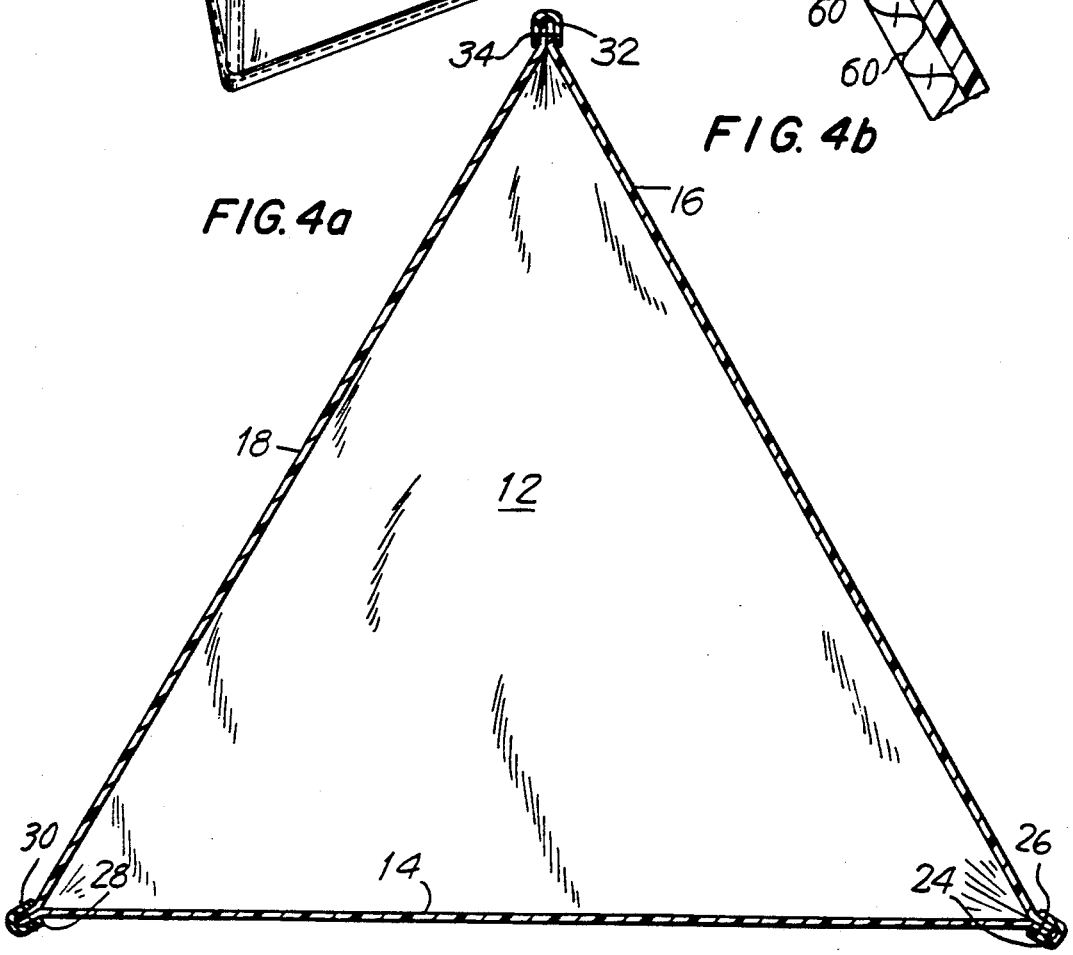

REUSABLE BAG

BACKGROUND OF THE INVENTION

The invention is directed to a bag for carrying many items such as groceries or the like, and in particular, to a reusable bag for carrying such items.

Recent concern for the environment and the use of throw-away items has given rise to a need for reusable everyday items one of which is bags for carrying groceries or the like. Several reusable bags are known. These bags fall into one of two types of bags. The first type, is a formless bag such as the handled plastic bags. These bags are made of a durable plastic or a canvas having a sack-like body. A pair of opposed handles may be provided at the top of the sack for aiding carrying. These bags are water resistant. However, because these bags have a sack-like construction, they are formless so that as heavy articles are placed in the bag, there is a net force downward making the overall bag narrow preventing an efficient use of the space within the bag for holding articles. As the bag gets narrower, it becomes increasing more difficult to place additional items within the bag.

The second type of bag is illustrated by paper bags which do have form to them. However, they are not water resistant and they are not always provided with handles. Additionally, paper bags although provided with form do not have the proper material characteristics to repeatedly support very heavy loads. Accordingly, the paper bags often need to be carried from the bottom. Furthermore, when paper bags get wet, they are destroyed and therefore must be thrown away. Also, paper bags due to their construction and material properties do not survive more than several reuses without tearing or destruction. Accordingly, to overcome the deficiencies of the prior art bags, the grocery industry often utilizes a plastic or canvas bag in combination with a paper bag. This results in the paper bag giving form to the canvas or plastic bag and the plastic or canvas bag giving support to the paper bag overcoming the deficiencies of each. However, the utilization of both types of bags is wasteful and uneconomical in that it requires twice the use of materials to perform a single job. Additionally, paper bags are less likely to be reused when used with canvas as the paper bags are supplied at the point of purchase and are not readily reusable without the properties of the canvas bag.

It is also known to utilize luggage which maintains its form when carrying heavy articles to carry articles such as groceries. However, luggage is not adequately suitable for the function of carrying grocery or shopping items of the like as it does not provide easy access through the top of the bag. Accordingly, it suffers from the disadvantage that the user of the luggage must lay the luggage on its side and reopen it utilizing fastening means such as a zipper, buckles or the like each time the user wishes to remove an article from the bag.

Accordingly, it is desirable to provide a reusable bag which is water resistant, provides proper support for the articles contained therein and maintains its shape when carrying articles.

SUMMARY OF THE INVENTION

Generally speaking, in accordance with the invention, a reusable bag includes a base. A plurality of sides are affixed to the base. The base and sides of the reusable bag are formed of a semi-rigid form maintaining material such as polyolefin weave which maintains its form while allowing each side to collapse upon itself.

In an exemplary embodiment, the base is formed as a triangular panel. At least two handles are provided. The first handle is affixed across one side. The second handle is affixed between the two remaining sides of the reusable bag.

Accordingly, it an object of the invention to provide an improved reusable bag.

Another object of the invention is to provide a reusable bag which is lightweight, maintains its form during use and is able to efficiently maintain the space required to support articles therein.

Yet another object of the invention is to provide a reusable bag which may be collapsed upon itself for storage and maintain its form for future uses.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description, taken in connection with the accompanying drawings, in which:

FIG. 3 is a perspective view the reusable bag constructed in accordance with the invention in an open position;

FIG. 4*a* is a sectional view taken along lines 4*a*—4*a*; and

FIG. 4*b* is a fragmented enlarged view of a side wall of FIG. 4*a*.

DESCRIPTION OF THE PREFERRED EMBODIMENT

Figure 1:
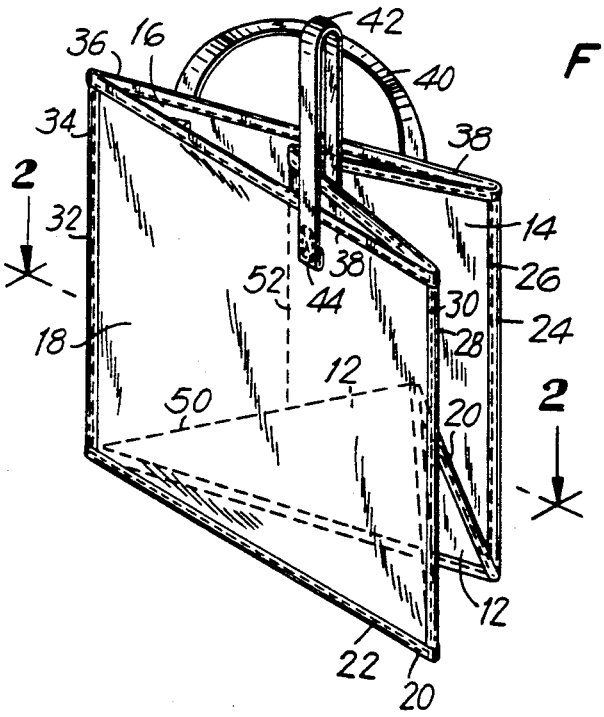
FIG. 1 is a perspective view of a reusable bag constructed in accordance with the invention shown in a first folding step.

Reference is made to FIGS. 3 and 4, wherein a reusable bag generally indicated as 10, includes a base panel 12. Base panel 12 is formed as a triangle. A first side panel 14 is affixed to base panel 12 and extends away therefrom at a substantially right angle to form a corner therebetween. A side panel 16 is affixed to base panel 12 and side panel 14 extending at a substantially right angle relative to base panel 12 and at an acute angle relative to side panel 14 forming a corner between side panel 16 and base panel 12, respectively. A side panel 18 is disposed adjacent panel 12 and between side panel 14 and side panel 16 extending at a substantially right angle away from base panel 12 panel and forming a corner between side panel 18 and each of base panel 12 and side panels 14, 16.

Base panel 12 is affixed to side panels 14, 16 and 18 by a border tape 20 which is sewn between base panel 12 and each of side panels 14, 16 and 18, utilizing a thread 22. Side panel 14 is affixed to side panel 16 utilizing a border tape 24 sewn between side panel 14 and side panel 16 by a thread 26 forming a corner therebetween. Similarly, side panel 14 is affixed at its other end to side panel 18 by a border tape 28 maintained in place by a thread 30. A border tape 32 connects panel 16 to side panel 18 utilizing a thread 34. A border tape 36 extends about the top of reusable bag 10 and is affixed thereto by a thread 38. Each of the border tapes is formed by way of example from a plastic strip.

Each of base panel 12 and side panels 14, 16 and 18 is formed of a semi-rigid material which maintains its shape but allows itself to be folded or crushed against itself. Accordingly, when unfolded or "open" as shown in FIG. 3, reusable bag 10 provides a stable reusable bag having a tripod base which maintains its form and an open top for easy access. Boundary tapes 20, 24, 28, 32 and 36 provide additional support to reusable bag 10 and although not necessary contribute to maintaining the form of reusable bag 10. By way of example, as seen in FIG. 4*b*, each of base panel 12 and side panels 14, 16 and 18 are made of a polyethylene weave formed by "threads" 60 slit from sheets of polyethylene which are woven together and then laminated on at least one side to a film 62 formed of polyolefin such as polyethylene. Polyethylene is used by way of example and any polyolefin or the like may be used. By utilizing a semi-rigid material for side and base panels, the side panels are maintained in a predetermined spaced relationship with each other when the bag is in the open position. Such a material does not absorb water or other liquids associated with foods and therefore retains its structural integrity even when exposed to liquid.

During weaving each "thread" of material can be deformed to provide an overall aesthetic look of non-uniformity. Additionally, either individual threads or the laminate layer may be colored to provide an overall pleasing ornamental look.

Handles 40, 42 are provided on reusable bag 10 to facilitate carrying of reusable bag. Handle 40 is affixed to panel 16 by thread 43 and handle 42 is affixed between panels 14 and 18 by thread 44.

Base panel 12 by being formed of a semi-rigid material having a definite shape is a preformed bottom which provides support to reusable bag 10. Additionally, it maintains side panels 14, 16 and 18 in spaced relationship to prevent sagging when a number of articles are placed within reusable bag 10 allowing more items to be placed within the bag than in the conventional reusable canvas and plastic bags. Furthermore, the triangular shape of base panel 12 of a preferred embodiment provides a tripod support, a more stable configuration than the form of the canvas and plastic prior art bags. In a preferred embodiment, base panel 12 is formed as an equilateral triangle and side panels 14, 16 and 18 are formed as squares. Applicants note, that a triangular shape is used by way of example only and that a base panel formed in other shapes such as a circle, square, hexagon or the like may equally be suited. Additionally, because the materials used for the side panels and bottom panel are semi-rigid and have shape memory, they return to their form after being folded. Portions of the entire bag as well as the entire bag itself may be formed of a unitary preformed material. In a preferred embodiment bag 10 is formed of a water resistant material.

Figure 2:
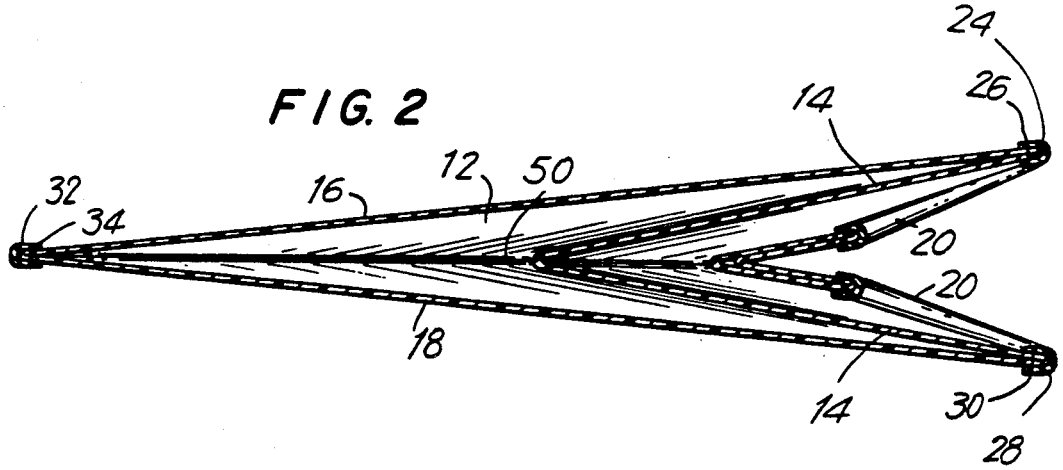
FIG. 2 is a sectional view taken along line 2—2 of FIG. 1 with a fragmentary enlarged view showing the material of one side panel.

As seen in FIGS. 1 and 2, reusable bag 10 may be folded for storing by folding bottom panel 12 about a fold line 50 substantially folding bottom panel 12 into two sections. Substantially simultaneously with folding bottom panel 12, side panel 14 is folded about a fold line 52 while handle 42 is folded upon itself as seen in FIG. 1. This folding substantially flatten reusable bag 10 upon itself. Although not shown, bag 10 may then be refolded upon itself as many times as necessary to fit into a convenient space for storage. The materials used for side panels 14, 16 and 18 and base panel 12 have memory in that they remember their form even after folding so that when unfolded, reusable bag 10 provides a stable preformed bag.

By providing a bag having a base panel coupled to a plurality of side panels extending away therefrom in the same direction at substantially right angles relative to the base panel, and forming each of the panels from a material which is water resistant and collapsible upon itself without permanently losing its shape, an improved reusable bag having form, the ability to maximize use of space within bag making use of materials in an economical manner is provided. By forming the base of a triangle and utilizing three side panels, a triangular tripod support is formed providing a stable configuration. Use of the preformed bottom prevents sagging and keeps the side at spaced intervals allowing easy access to the contents of the bag while preventing heavy loads from decreasing the useable space within the bag.

It will thus be seen that the objects set forth above, among those made apparent from the preceding description, are efficiently attained and, since certain changes may be made in the above construction without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A reusable bag for carrying groceries, said reusable bag being adapted to be in either an open or closed position, said reusable bag comprising a base, a plurality of sides affixed to said base extending away therefrom in substantially the same direction, the base and sides of said reusable bag being formed of a semi-rigid form maintaining material, said base forming a triangle and each of said base and sides maintaining said bag in said open position while allowing said base and at least one of said sides to fold upon itself in said closed position, and a first handle having a first end and a second end, a second handle having a third end and a fourth end, said first end and second end each being affixed to a first one of said three sides, said third end being affixed to a second one of said three sides, and said fourth end being affixed to a third one of said three sides.

2. The reusable bag of claim 1, further comprising backing means for affixing each of said at least three side panels to said base panel and to each other remaining side panel and assisting in maintaining the shape of said bag in the unfolded position.

3. The reusable bag of claim 2, wherein said backing means is border tape.

4. The reusable bag of claim 1, wherein said base panel and at least three side panels are formed as a single panel.

5. The reusable bag of claim 1, wherein each of said base panel and said at least three side panels are water resistant.

6. The reusable bag of claim 1, wherein said base panel and said three side panels are formed of a polyolefin weave.

7. The reusable bag of claim 1, wherein at least one of said base panel and said three side panels are formed of a polyolefin weave laminated on at least one side to a polyolefin sheet.

8. A reusable bag for carrying groceries and adapted to be folded and unfolded, comprising a base panel, forming a triangle, three side panels, each side panel being affixed to said base panel and extending in a substantially same direction from said base panel and being maintained in a predetermined spaced relation relative to each other by said base panel, and each of said base panel and said three side panels maintaining the shape of said bag in the unfolded position after said bag has been folded and unfolded; and a first handle having a first end and a second end, a second handle having a third end and a fourth end, said first end and second end each being affixed to a first one of said three side panels, said third end being affixed to a second one of said three side panels, and said fourth end being affixed to a third one of said three side panels.

9. The reusable bag of claim 7, wherein said base panel and said three side panels are formed of a polyolefin weave.

10. The reusable bag of claim 8, further comprising backing means for affixing each of said three side panels to said base panels and to each other remaining side panel and assisting in maintaining the shape of said bag in the unfolded position, said backing means being a border tape.

11. A reusable bag adapted to be folded and unfolded, comprising a base panel, forming a triangle, three side panels, each side panel being affixed to said base panel and to the adjacent side panels and extending in a substantially same direction from said base panel and being maintained in a predetermined spaced relation relative to each other by said base panel; and a first handle having a first end and a second end, a second handle having a third end and a fourth end, said first end and second end each being affixed to a first one of said three side panels, said third end being affixed to a second one of said three side panels, and said fourth end being affixed to a third one of said three side panels.

* * * * *